US011850602B2

(12) United States Patent
Kalala

(10) Patent No.: US 11,850,602 B2
(45) Date of Patent: Dec. 26, 2023

(54) FLASH MILLING INSIDE A FLOTATION CELL

(71) Applicant: Johnny Tshibangu Kalala, Johannesburg (ZA)

(72) Inventor: Johnny Tshibangu Kalala, Johannesburg (ZA)

( * ) Notice: Subject to any disclaimer, the term of this patent is extended or adjusted under 35 U.S.C. 154(b) by 710 days.

(21) Appl. No.: 16/968,021

(22) PCT Filed: Feb. 5, 2019

(86) PCT No.: PCT/ZA2019/050005
§ 371 (c)(1),
(2) Date: Aug. 6, 2020

(87) PCT Pub. No.: WO2019/157539
PCT Pub. Date: Aug. 15, 2019

(65) Prior Publication Data

US 2021/0031210 A1 Feb. 4, 2021

(30) Foreign Application Priority Data

Feb. 6, 2018 (ZA) ..... 2018/00763

(51) Int. Cl.

| | |
|---|---|
| ***B02C 17/00*** | (2006.01) |
| ***B02C 23/36*** | (2006.01) |
| ***B03D 1/14*** | (2006.01) |
| ***B02C 17/16*** | (2006.01) |
| ***B02C 17/18*** | (2006.01) |
| ***B02C 23/38*** | (2006.01) |

(52) U.S. Cl.
CPC ..... *B02C 23/36* (2013.01); *B02C 17/161* (2013.01); *B02C 17/183* (2013.01); *B02C 17/1845* (2013.01); *B02C 23/38* (2013.01); *B03D 1/1456* (2013.01); *B03D 2203/02* (2013.01)

(58) Field of Classification Search
CPC ..... B02C 23/36; B02C 17/16; B02C 17/166; B02C 17/1855
See application file for complete search history.

(56) References Cited

U.S. PATENT DOCUMENTS 2,239,952 A * 4/1941 Dergance ..... B02C 19/00 241/46.11
3,779,469 A * 12/1973 Putman ..... B02C 25/00 241/34
3,881,660 A * 5/1975 Ribas ..... B02C 19/066 241/39
3,912,174 A * 10/1975 Karpinski ..... B03B 9/00 241/24.1

(Continued)

OTHER PUBLICATIONS

International Search Report dated Jul. 26, 2019 from priority PCT Application No. PCT/ZA2019/050005 (five pages).

(Continued)

*Primary Examiner* — Faye Francis
(74) *Attorney, Agent, or Firm* — Tutunjian & Bitetto, P.C.

(57) ABSTRACT

A grinding device suitable for operating inside a flotation cell which includes three zones including a collecting zone in which particles are collected though a settling process, a grinding zone in which particles undergo a size reduction process and a pumping zone from which milled particles are recycled to the flotation cell.

4 Claims, 4 Drawing Sheets

(56) References Cited

U.S. PATENT DOCUMENTS

| | | | | | |
|---|---|---|---|---|---|
| 4,063,903 | A | * | 12/1977 | Beningson | B02C 21/00 110/220 |
| 4,287,054 | A | * | 9/1981 | Hollingsworth | B03D 1/1456 261/DIG. 75 |
| 4,964,576 | A | | 10/1990 | Datta | |
| 5,472,094 | A | * | 12/1995 | Szymocha | B03D 1/16 209/168 |
| 2013/0206877 | A1 | * | 8/2013 | Haarla | D21D 1/006 241/47 |
| 2017/0312759 | A1 | * | 11/2017 | Steinwender | B02C 17/184 |

OTHER PUBLICATIONS

Written Opinion dated Jul. 26, 2019 from priority PCT Application No. PCT/ZA2019/050005 (nine pages).

* cited by examiner

FIGURE 1A (PRIOR ART-MF1)

FIGURE 1B (PRIOR ART-MF2)

FIGURE 1C (PRIOR ART-MFX)

FLASH MILLING INSIDE A FLOTATION CELL

This application is a National Stage application of International Application No. PCT/ZA2019/050005, filed Feb. 5, 2019, wherein the above-mentioned International Application claims the benefit under 35 U.S.C. § 119(a) of the filing date of Feb. 6, 2018 of South African Patent Application No. 2018/00763, the entire contents of each of which are incorporated herein by reference.

BACKGROUND OF THE INVENTION

Field of the Invention

The present invention relates to milling equipment capable of operating continuously inside a flotation cell to allow flotation and milling to be conducted simultaneously.

Related Processes

In the mineral processing industry, in order to concentrate an ore using froth flotation, it is important to reduce the size of run-of-mine ore to liberate utile minerals from gangue, and to reach a size distribution which can be handled by the flotation process. The size reduction process is conducted separately in a crushing process followed by a milling process. The ore is typically reduced to a size distribution ranging from a few mm to a few microns before commencing the flotation process. The size to which the ore is reduced is linked to the extent to which utile minerals and gangue are liberated.

The froth flotation concentration is conducted by using the differences in the ability of air bubbles to selectively adhere to surfaces of specific minerals in a slurry. The particles which adhere to air bubbles are then carried to the surface and removed, while the particles that do not adhere to air bubbles remain wet and stay in the liquid phase. The flotation process is strongly influenced by the upstream crushing and milling of the ore. Metallurgical flotation performance (recovery, grade, mass pull) is improved when a narrow feed particle size distribution is achieved. This is a difficult task to achieve practically.

To improve flotation metallurgical performance, liberated particles should be recovered as they are generated to avoid being re-milled to a finer particle size, the recovery of which is relatively low.

A milling and flotation process can be done in two or more stages to recover liberated particles before re-milling the tailings. This approach improves metallurgical performance compared to single stage milling and flotation.

The implementation of a multi-stage milling and flotation process, however, requires a larger plant size resulting in a corresponding increase in process CAPEX and OPEX.

An aim of the present invention is to address, at least partly, the aforementioned problems.

SUMMARY OF THE INVENTION

Since conducting milling and flotation in several stages is CAPEX intensive, it is proposed to perform the milling and flotation continuously in one process. To this end, the invention provides a grinding device suitable for operating inside a flotation cell. The grinding device is equipped with three main zones: a collecting zone in which particles are collected through a settling process; a grinding zone in which particles undergo a size reduction process; and a pumping zone from which milled particles are recycled to the flotation cell.

The grinding device may be configured to be inserted into an existing flotation cell, or to be removed therefrom, without interrupting a flotation process. Preferably, the device is locatable in a dead zone formed in the flotation cell.

The flotation process is dynamic and the dead zone changes in shape, and volume; so, too, do the properties of the particles in the dead zone. The exact location of the dead zone is a function of the variation in the flotation operating conditions. The grinding device is therefore designed with the possibility of changing its position inside a flotation cell to optimize its impact on flotation performance.

The size and capacity of the grinding device may depend on a size of the flotation cell in which the device is to be fitted. The orientation of the device inside the flotation cell (e.g. the inclination of a longitudinal axis of the device, to the vertical) is determined based on an assessment of slurry flow in the flotation cell and may be variable inline (i.e. in real time) to optimize a flash flotation performance. The variation of the device's orientation inline allows the resulting slurry to be discharged at different angles, and for more particles to be collected.

According to a second aspect, the present invention provides a method of conducting a continuous milling and flotation process that includes the steps of:

1. providing a device of the aforementioned kind;
2. installing the device in a dead zone of a flotation cell;
3. directing a process stream containing ore particles into the flotation cell;
4. operating the flotation cell to separate the ore particles from gangue minerals in the process stream; and
5. operating the device to continuously mill ore particles that are collected in the device's collecting zone during the flotation process.

BRIEF DESCRIPTION OF THE DRAWINGS

The present invention is further described by way of example with reference to the accompanying drawings in which:

FIG. 1A is a flowsheet representing a milling and flotation circuit operating in one stage (prior art);

FIG. 1B is a flowsheet representing a milling and flotation circuit operating in two stages (prior art);

FIG. 1C is a flowsheet representing a milling and flotation circuit operating in several stages (prior art);

DESCRIPTION OF PREFERRED EMBODIMENT

Figure 1D:
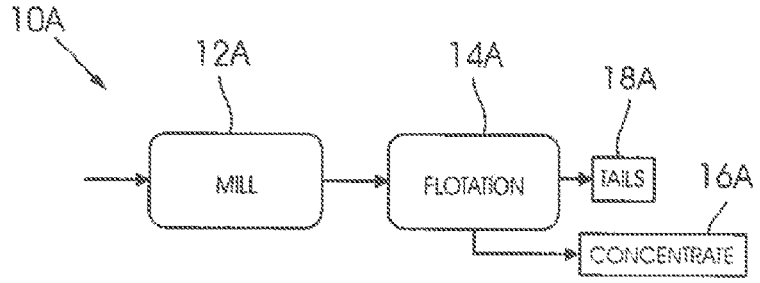
FIG. 1D is a flowsheet representing a milling and flotation circuit operating continuously using a device according to the present invention.
Figure 1D:
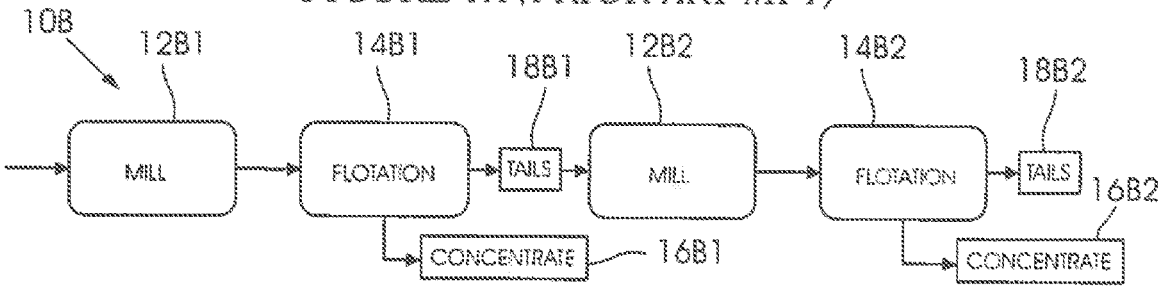
Figure 1D:
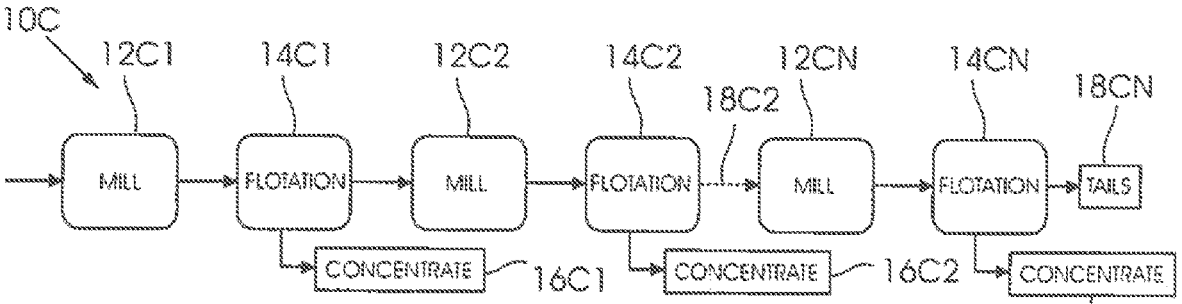
Figure 1D:
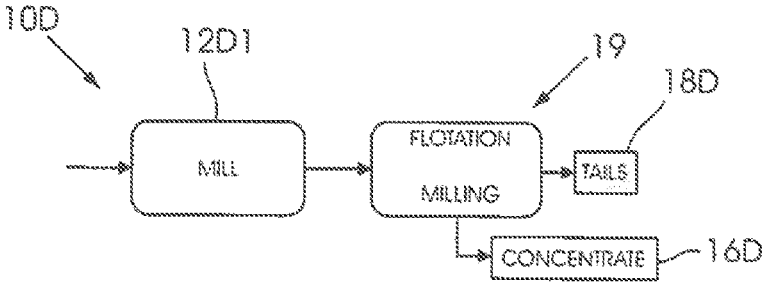

FIGS. 1A, 1B and 1C, respectively, illustrate circuits 10A, 10B and 10C, utilizing a milling unit 12 and a flotation cell 14, in one stage (MF1), two stages (MF2), and multiple stages (MFX), respectively. These circuits form part of the prior art. In each instance, an ore is milled in the milling unit 12 to a target grind before being transferred to the flotation cell 14. A concentrate 16, containing target metal values, and tailings 18, exit a respective flotation stage.

In the MF2 and MFX circuits 10B and 10C, respectively, the flotation tailings report back to a respective milling unit 12B and 12C to be ground, and the ground tailings 18 are transferred to a flotation cell 14B and 14C. The concentrate 16, containing a target metal, exits the flotation phase. In the MFX circuit 10C this procedure is repeated until all the target metal contained in the ore has been concentrated.

Comparative test work, conducted on different ore types, in the MF1 (FIG. 1A) circuit and the MF2 (FIG. 1B) circuit, typically shows an improvement in recovery ranging from 1 to 4% when the MF2 (FIG. 1B) circuit is used. However, a plant CAPEX and OPEX are significantly higher when implementing the MF2 (FIG. 1B) circuit, or the MFX (FIG. 1C) circuit, compared to the CAPEX and OPEX of the MF1 (FIG. 1A) circuit.

FIG. 1D is a flowsheet illustrating a continuous milling and flotation process 10D according to the present invention. Milling and flotation are achieved within the same unit 19 which includes a flotation cell 14 with a grinding device 20 (FIG. 2) mounted therein.

Figure 2:
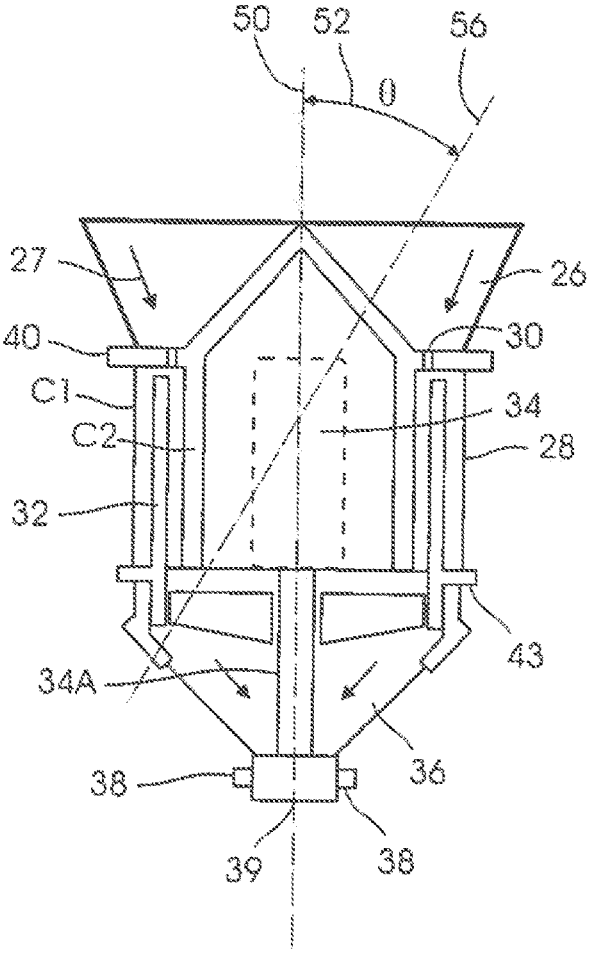
FIG. 2 is a diagrammatical depiction of a device according to the present invention.
Figure 2:
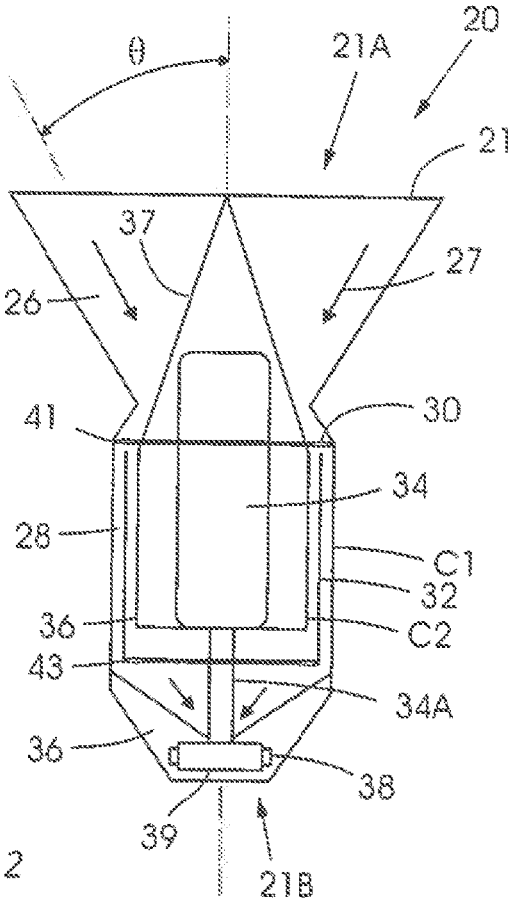

FIG. 2 schematically shows the grinding device 20 according to the present invention. The grinding device 20 includes a housing 21 with a flared upper end 21A and a lower end 21B in the form of a first static cylinder C1. A second static cylinder C2 is positioned inside the first static cylinder C1, concentrically therewith.

The housing 21 includes a collection zone 26, a grinding zone 28 and a pumping zone 36.

The grinding zone 28 is located in an annular cylindrical space between the first and the second static cylinders C1, C2.

The grinding device 20 includes a variable speed submersible motor 34 and a rotating grinder 32 which is attached to a shaft 34A of the motor 34 and which is located in the grinding zone 28.

The rotating grinder 32 is a cylindrical or pin grinder and is rotatable in the grinding zone 28 between the first and the second static cylinders C1, C2.

A conical cap 37 is located over an upper end of the second static cylinder C2, inside the flared upped end 21A. In this way a downwardly inclined funnel formation is formed to direct material into an upper end of the grinding zone 28. A perforated plate 41, with a specific open area at the upper of the grinding zone 28, separates the collection zone 26 from the grinding zone 28. The plate has inlets 30.

The grinding device 20 is equipped with:

1. the variable speed submersible motor 34 to control the milling action (energy input) and reintroduction of slurry and air into the flotation cell 14;
2. reagent addition pipes (not shown) to add any reagent directly into the grinding zone 28 or pumping zone 36;
3. grinding media addition pipes (not shown) to add the grinding media inline while the grinding device 20 is operating;
4. probes (not shown) to monitor the pH and redox potential inside the grinding zone 28 or pumping zone 36;
5. sampling pipes (not shown) for collecting material from the flotation cell 14 or pumping zone 36; and
6. a discharge mechanism from the flotation cell 14 which promotes the generation of small bubbles which are beneficial for flotation.

In use of the unit 19, slurry and air are collected in the collection zone 26.

The conical funnel shape of the collection zone 26 encourages settling of particles 27 and is designed to facilitate a classification thereof with relatively coarser particles entering the grinding zone 28 through the inlets 30, while relatively finer particles are mostly not collected.

Grinding media (e.g. suitable ceramic media) are used inside the grinding zone 28 for size reduction of the ore. The grinding media size is selected to avoid over-milling of the ore. Since grinding media wear over time, the design allows inline addition of grinding media through a pipe connected directly to the grinding zone 28. A grate discharge 43 at a lower end of the grinding zone 28 is used as a control to keep the grinding media inside the grinding zone 28 while the milled slurry is transferred into the pumping zone 36.

The pumping zone 36 collects slurry from the grinding zone 28 and any slurry that may have by-passed the grinding zone 28. A pump 39 with an impeller inside a casing, equipped with a single or double discharge is positioned in the pumping zone 36. The pump 39 circulates the slurry and air to the flotation cell 14 from the grinding device 20 via an outlet 38. The pump impeller is designed to promote generation of small bubbles to improve flotation performance.

Particles 27 which are not liberated or which have a weak attachment to flotation bubbles circulate to the collection zone 26 of the grinding device 20. These particles 27 re-enter the grinding zone 28, and are then re-milled to an appropriate size. The milled particles then join the slurry in the flotation cell 14 via the pumping zone 36.

Since the flotation is conducted in batch mode i.e., in banks of flotation cells, a respective grinding device 20 can be included in each of a plurality flotation cells 14. The use of the continuous milling and flotation process of the present invention negates the necessity of using multistage milling and flotation to improve flotation performance, and also results in a better overall liberation, bubble size and circulation of particles inside flotation cells 14.

The orientation of the grinding device 20 is dependent on various factors including, in particular, the nature of slurry flow inside the flotation cell 14.

The residence time of particles inside the grinding zone 28 is only a few seconds, hence the term "flash milling" is used to describe the milling process. The design of the grinding zone 28 and the use of suitable grinding media encourage the creation of new surface areas on the ore particles while avoiding the generation of ultrafine particles. The grinding device 20 has a longitudinal axis 50. The grinding device 20 can be tilted in any direction through an angle 52 so that the axis 50 extends in a direction 56, to achieve optimum performance of the grinding device 20 inside the flotation cell 14.

Figure 3:
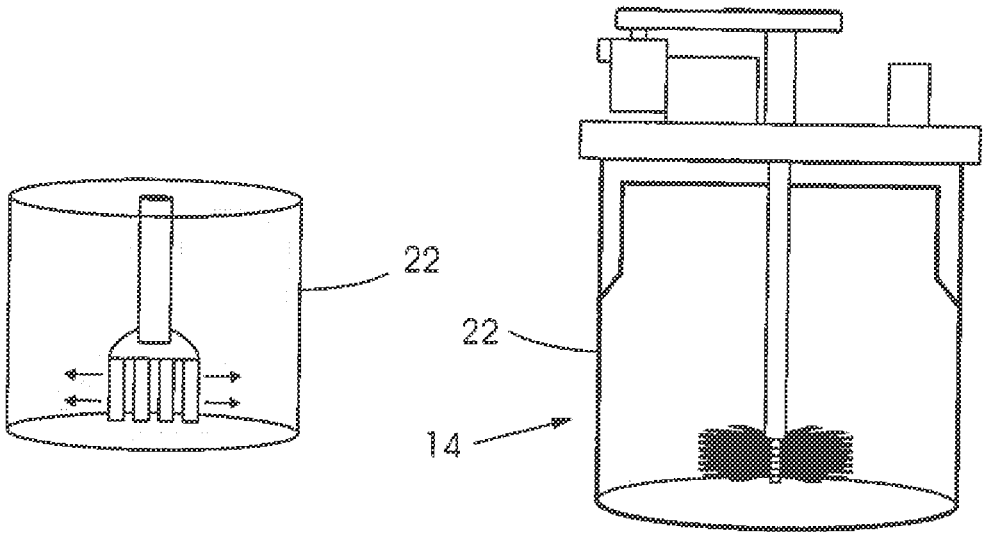
FIG. 3 shows a dead zone in a flotation cell where a device of the kind shown in FIG. 2 could be located.
Figure 4:
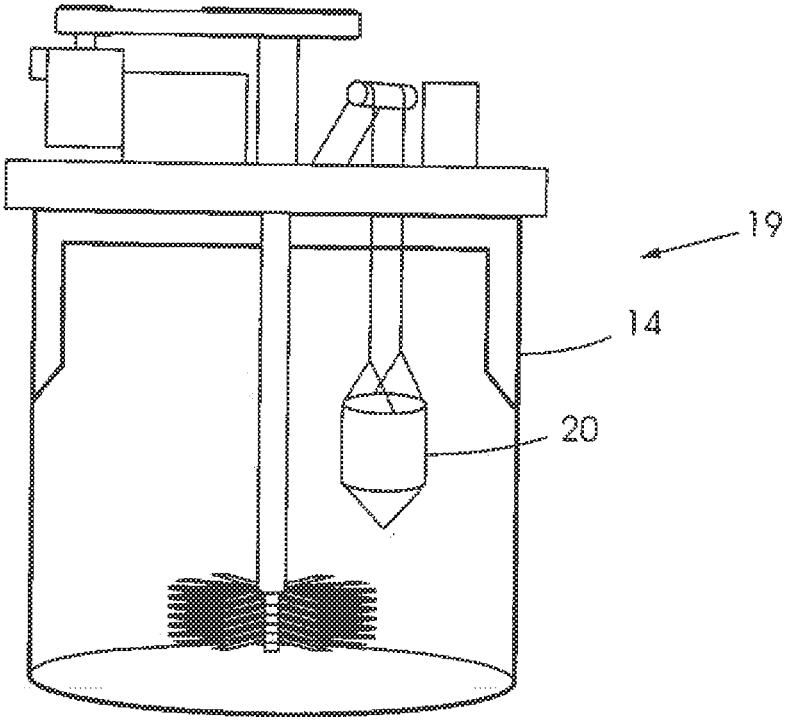
FIG. 4 shows a flotation cell with the device of FIG. 2 installed in a dead zone of the flotation cell.

FIGS. 3 and 4 show a dead zone 22 formed within the flotation cell 14 where the grinding device 20 can be inserted. The dead zone 22 is a location in which the relative motion of ore particles is considerably low. The particles move in a vortex around the dead zone 22 and thus the grinding device 20 does not significantly interfere with the flotation process.

Figure 5:
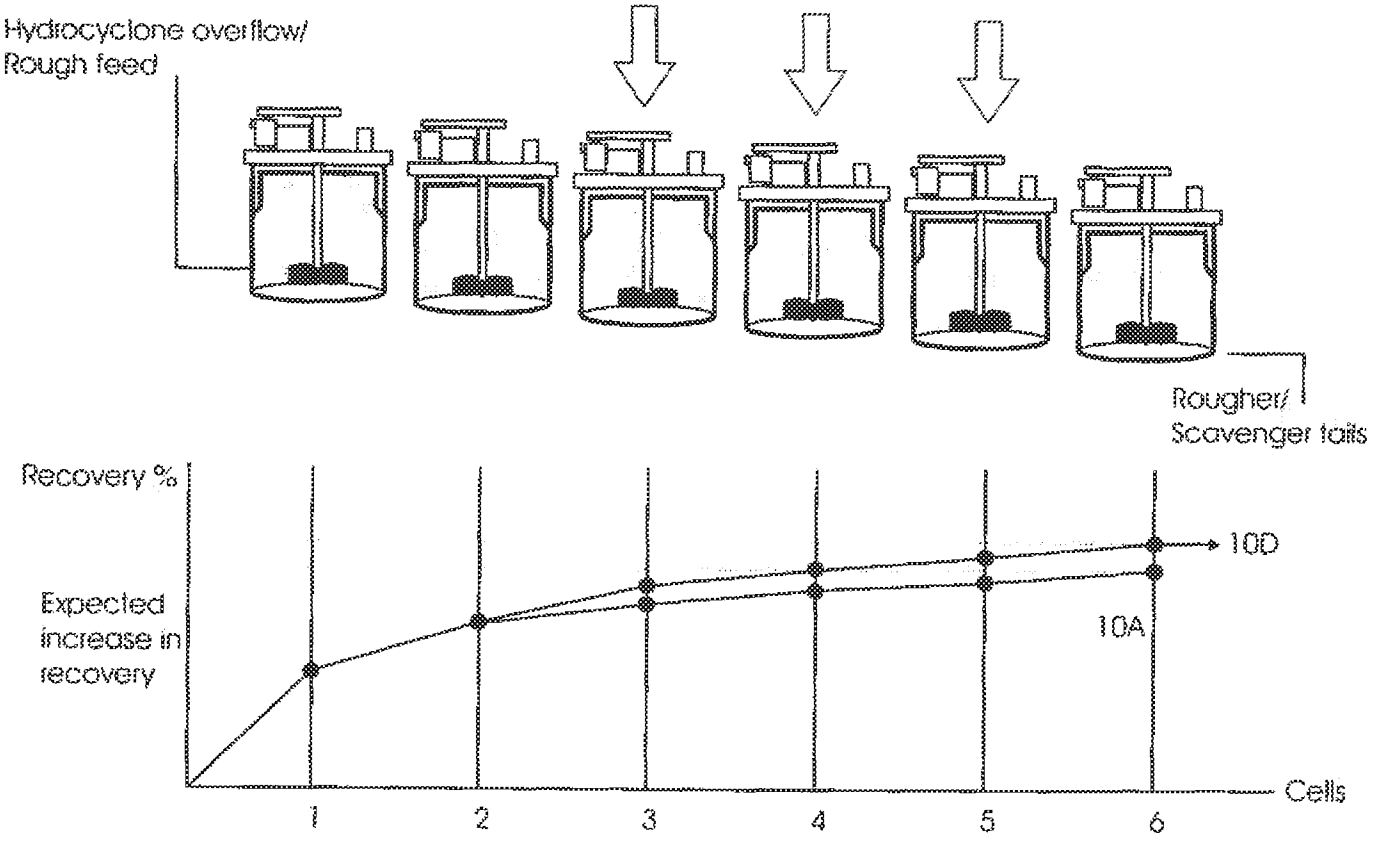
FIG. 5 is a graph depicting an expected increase in ore particle recovery using a device according to the present invention.

FIG. 5 shows a marked improvement in the expected recovery of the ore or ore concentration compared to the circuits 10A, 10B and 10C.

EXPERIMENTAL PROCEDURE

The incorporation of the grinding device 20 in the flotation cell 14 is based on analyses of an existing flotation circuit performance. Particle size distribution, chemical and mineralogical analyses were conducted on different streams of the flotation circuit to understand its performance. Analyses (particle size distribution, chemical and mineralogical) were also conducted on samples taken from inside the grinding device 20 at different depths and locations inside the flotation cells. Laboratory batch flotation tests were also conducted on different samples after milling to predict the expected performance to be achieved by inserting the grinding device 20 into the flotation cell 14.

Data generated from these analyses and test work were used to determine:

a) the optimum number of flotation cells, in a bank, into which respective grinding devices 20 are to be inserted;
b) the optimum location inside a flotation cell 14 at which the grinding device 20 should be operating;
c) the size, capacity, orientation and geometry of the grinding device 20;
d) the specific energy requirement and milling operating conditions to be used to maximise the flotation performance; and
e) the expected improvement in metallurgical performance.

Laboratory versions of the grinding device 20 were also designed to operate in batch and pilot flotation cells 14 of 2.5 L, 5 L, 10 L and 40 L respectively. Standard operating procedures for the use of laboratory versions were developed to ensure scalability of the results to an industrial scale.

The invention claimed is:

1. A grinding device located inside a dead zone in a flotation cell, the grinding device comprising:

a housing;
a collection zone with a funnel shape at an upper end of the housing which allows settling of particles from the flotation cell;
a grinding zone in which particles are milled to undergo a size reduction process;
an inlet through which particles pass from the collection zone to the grinding zone; and
a pumping zone in which slurry from the grinding zone is collected and which includes a pump which recycles milled particles into the flotation cell.

2. The grinding device according to claim 1, wherein the grinding device configured to be inserted into the flotation cell, or to be removed therefrom, without interrupting a flotation process in the flotation cell.

3. The grinding device according to claim 1, wherein the grinding device is locatable in a dead zone formed in the flotation cell.

4. The grinding device according to claim 1, further comprising a control in the form of a grate discharge at a lower end of the grinding zone configured to keep grinding media inside the grinding zone while milled slurry is moved into the pumping zone.

* * * * *